US010490047B1

(12) United States Patent
Nardi

(10) Patent No.: US 10,490,047 B1
(45) Date of Patent: Nov. 26, 2019

(54) INTRUDER ALARM AND DISORIENTING DEVICE

(71) Applicant: Rodrigo Nardi, Providence, RI (US)

(72) Inventor: Rodrigo Nardi, Providence, RI (US)

( * ) Notice: Subject to any disclaimer, the term of this patent is extended or adjusted under 35 U.S.C. 154(b) by 0 days.

(21) Appl. No.: 16/124,340

(22) Filed: Sep. 7, 2018

(51) Int. Cl.
*G08B 15/00* (2006.01)
*G08B 7/06* (2006.01)

(52) U.S. Cl.
CPC ..... *G08B 15/00* (2013.01); *G08B 7/06* (2013.01)

(58) Field of Classification Search
CPC ..... G08B 13/1436; A63B 2055/402
USPC ..... 340/541
See application file for complete search history.

(56) References Cited

U.S. PATENT DOCUMENTS 5,091,715 A * 2/1992 Murphy ..... G01F 23/242 200/61.05
D346,982 S 5/1994 Greene
5,587,701 A * 12/1996 Hess ..... G08B 15/001 340/538
5,877,686 A * 3/1999 Ibey ..... G08B 13/1436 200/61.52
6,052,052 A 4/2000 Delmonaco
7,113,091 B2 9/2006 Script
2005/0030179 A1* 2/2005 Script ..... G08B 13/08 340/545.1
2007/0075854 A1* 4/2007 Tyler ..... G08B 5/36 340/541
2007/0152820 A1* 7/2007 Huang ..... G06F 3/0227 340/571
2011/0115627 A1* 5/2011 Smith ..... G08B 3/10 340/541
2013/0155242 A1* 6/2013 Hevia ..... G08B 13/19658 348/152
2017/0288315 A1* 10/2017 Scheucher ..... H01Q 19/30

FOREIGN PATENT DOCUMENTS

WO WO9812068 3/1998

* cited by examiner

*Primary Examiner* — Fabricio R Murillo Garcia

(57) ABSTRACT

An intruder alarm and disorienting device for home security includes a housing that defines an interior space. A battery and microprocessor are coupled to the housing and are positioned in the interior space. A sensor, a horn, and a plurality of bulbs are coupled to a front of the housing. The microprocessor is operationally coupled to the battery, the sensor, the bulbs, and the horn. The sensor is configured to detect an intruder who enters an area proximate to the front of the housing and to signal the microprocessor, positioning the microprocessor to sound the horn and to strobe the bulbs to disorient the intruder and to alert a user.

16 Claims, 4 Drawing Sheets

INTRUDER ALARM AND DISORIENTING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to intruder alarms and more particularly pertains to a new intruder alarm for home security.

BRIEF SUMMARY OF THE INVENTION

An embodiment of the disclosure meets the needs presented above by generally comprising a housing that defines an interior space. A battery and microprocessor are coupled to the housing and are positioned in the interior space. A sensor, a horn, and a plurality of bulbs are coupled to a front of the housing. The microprocessor is operationally coupled to the battery, the sensor, the bulbs, and the horn. The sensor is configured to detect an intruder who enters an area proximate to the front of the housing and to signal the microprocessor, positioning the microprocessor to sound the horn and to strobe the bulbs to disorient the intruder and to alert a user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
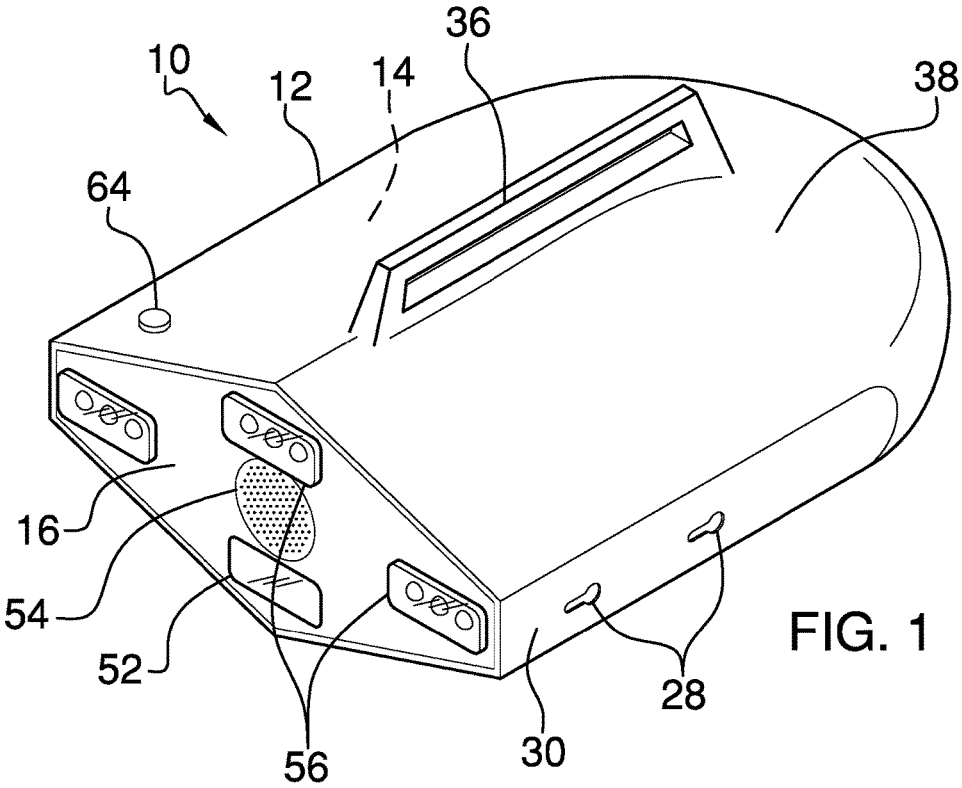
FIG. 1 is an isometric perspective view of an intruder alarm and disorienting device according to an embodiment of the disclosure.
Figure 2:
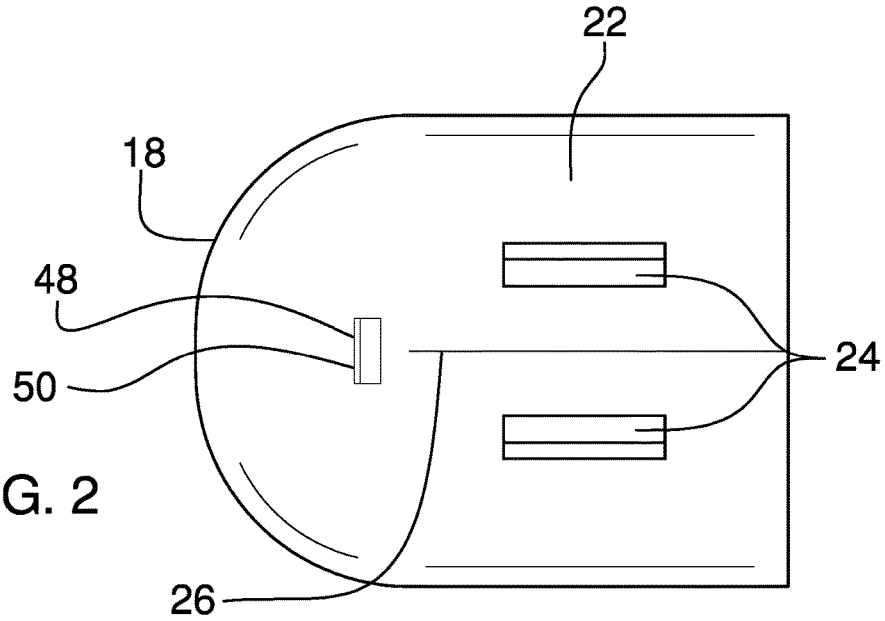
FIG. 2 is a bottom view of an embodiment of the disclosure.
Figure 3:
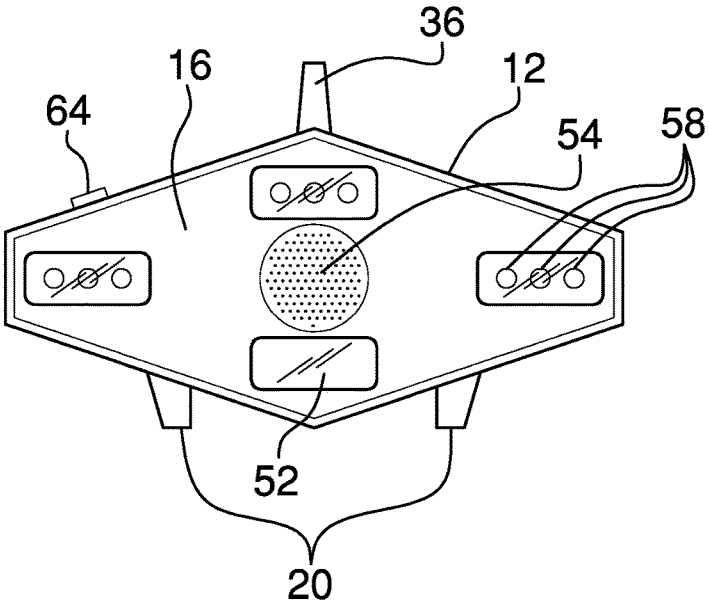
FIG. 3 is a front view of an embodiment of the disclosure.
Figure 4:
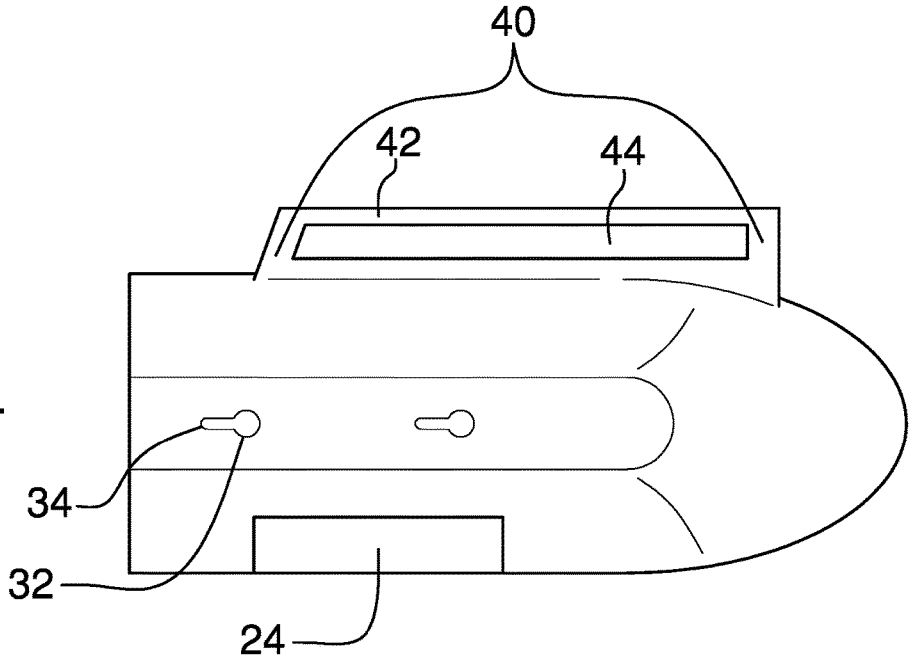
FIG. 4 is a side view of an embodiment of the disclosure.

With reference now to the drawings, and in particular to FIGS. 1 through 6 thereof, a new intruder alarm embodying the principles and concepts of an embodiment of the disclosure and generally designated by the reference numeral 10 will be described.

As best illustrated in FIGS. 1 through 6, the intruder alarm and disorienting device 10 generally comprises a housing 12 that defines an interior space 14. The housing 12, which is substantially rectangularly box shaped, has a front 16 and a back 18. The front 16 is flattened hexagonally shaped, while the back 18 is convexly arcuate.

A plurality of feet 20 is coupled to a bottom 22 of the housing 12. The feet 20 are configured to stabilize the housing 12 on a substantially horizontal surface, such as a floor of a structure. The plurality of feet 20 comprises a pair of bars 24 that bracket a midline 26 of the bottom 22.

Each of a plurality of couplers 28 is coupled to a respective opposing side 30 of the housing 12. The couplers 28 are configured to selectively couple to a substantially vertical surface to couple the housing 12 to the substantially vertical surface, such as a wall of the structure, with the housing 12 extending substantially perpendicularly from the substantially vertical surface. The feet 20 enable positioning of the housing 12 on the floor while the couplers 28 enable positioning of the housing 12 above the floor via coupling of the housing to the wall.

The plurality of couplers 28 comprises four couplers 28 that are positioned two-apiece on each opposing side 30 of the housing 12. Each coupler 28 comprises a hole 32 and a channel 34. The channel 34 extends from the hole 32 toward the front 16 of the housing 12. The hole 32 is configured to insert a head of an article of mounting hardware, such as a screw, bolt, or nail, so that the channel 34 is positioned to insert a shaft of the article of mounting hardware to couple the housing 12 to the substantially vertical surface.

A handle 36 is coupled to a top 38 of the housing 12 and is configured to be grasped in a hand of a user to lift the housing 12. The handle 36 comprises a pair of first rods 40 and a second rod 42. Each first rod 40 is coupled to and extends from the top 38 of the housing 12. The second rod 42 is coupled to and extends between the first rods 40 distal from the housing 12 to define a slot 44. The slot 44 is configured to insert digits of the hand of the user to grasp the second rod 42 and to lift the housing 12.

A battery 46 which is rechargeable, is coupled to the housing 12 and is positioned in the interior space 14. A connector 48 is coupled to the housing 12 and is operationally coupled to the battery 46. The connector 48 is configured to insert a plug to couple the battery 46 to a source of direct current to recharge the battery 46. The connector 48 comprises a Universal Serial Bus port 50 that is positioned on the bottom 22 of the housing 12.

A sensor 52, which is passive infrared type, is coupled to the front 16 of the housing 12. A horn 54 is coupled to the front 16 of the housing 12 and is centrally positioned on the front 16 of the housing 12.

A plurality of bulbs 56 is coupled to the front 16 of the housing 12. The plurality of bulbs 56 comprises three bulbs 56. Two of the bulbs 56 are positioned singly proximate to the opposing sides 30 of the housing 12, while one of the bulbs 56 is positioned proximate to the top 38 of the housing 12 and equally distant from the opposing sides 30 of the housing 12. Each bulb 56 comprises a set of light emitting diodes 58. Each set of light emitting diodes 58 comprises three light emitting diodes 58.

Figure 5:
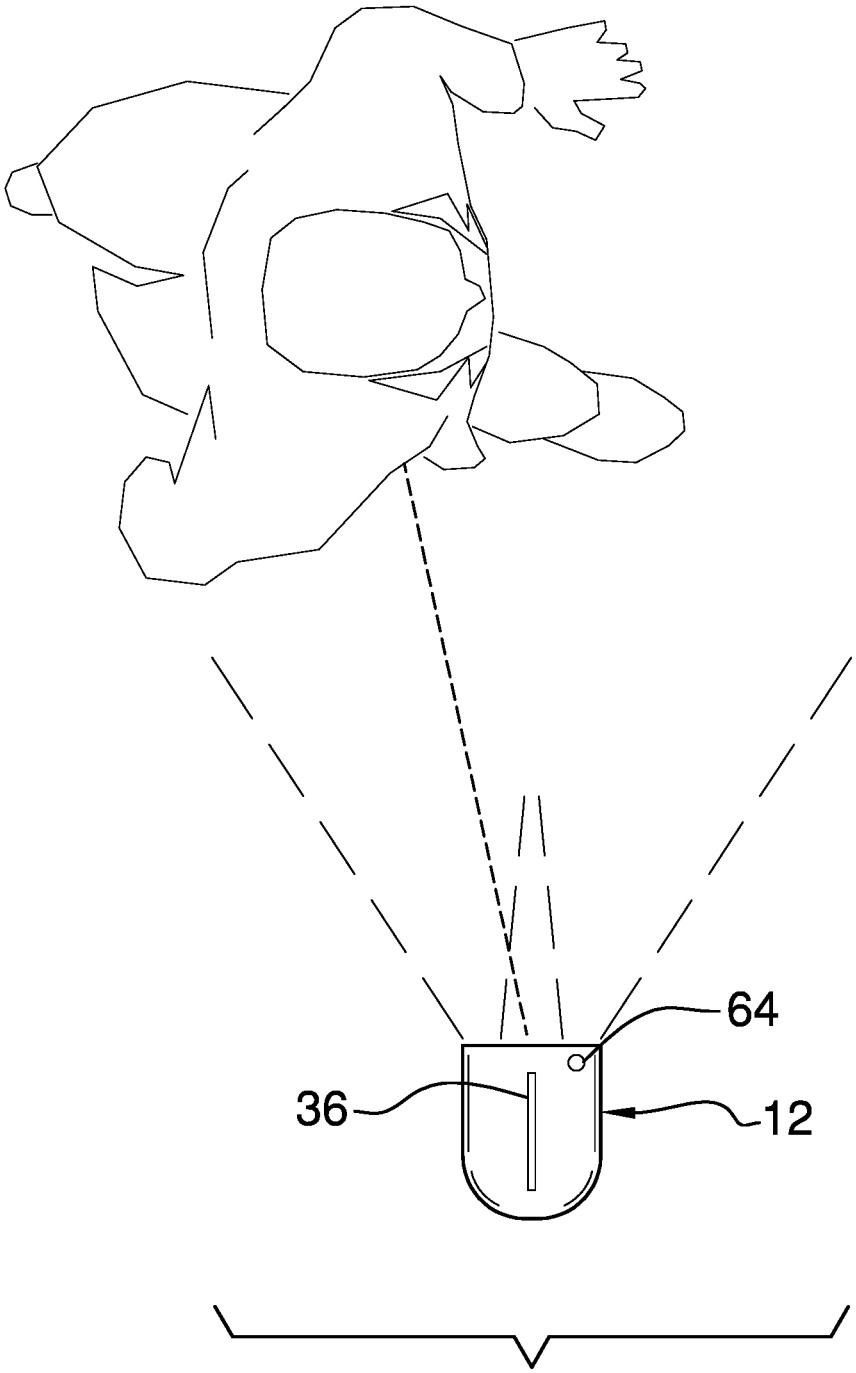
FIG. 5 is an in-use view of an embodiment of the disclosure.
Figure 6:
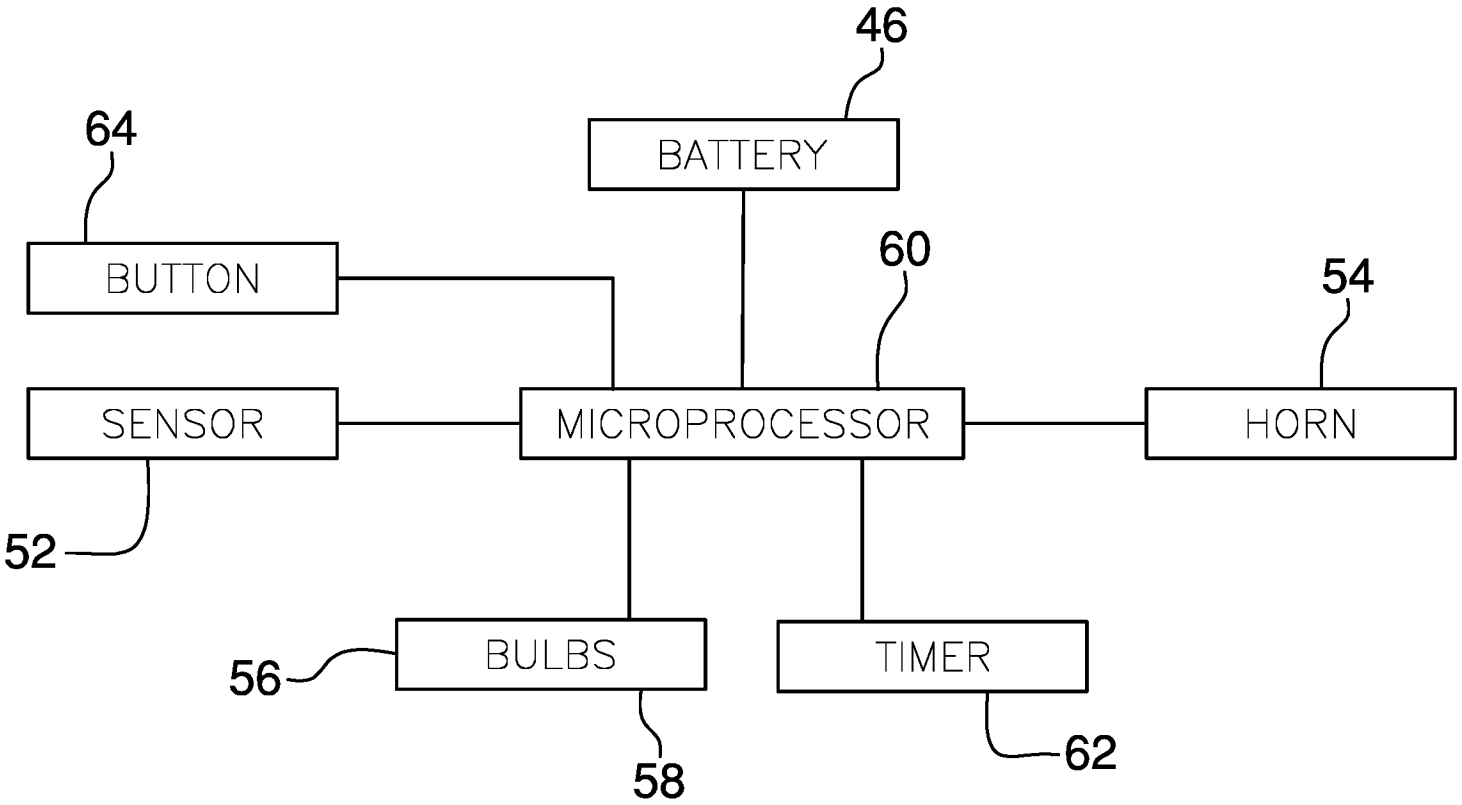
FIG. 6 is a block diagram of an embodiment of the disclosure.

A microprocessor 60 is coupled to the housing 12 and is positioned in the interior space 14. The microprocessor 60 is operationally coupled to the battery 46, the sensor 52, the bulbs 56, and the horn 54. The sensor 52 is configured to detect an intruder who enters an area proximate to the front 16 of the housing 12, as shown in FIG. 5, and to signal the microprocessor 60. The microprocessor 60 is positioned to sound the horn 54 and to strobe the bulbs 56 to disorient the intruder and to alert the user. The disorientation of the intruder manifests as a temporary threshold shift induced by the volume of the horn 54, which is greater than or equal to 150 decibels. The disorientation of the intruder also manifests as pupillary contraction and photoblocking of rhodopsin in the eyes of the intruder induced by the strobing of the bulbs 56.

A timer 62 is coupled to the housing 12 and is positioned in the interior space 14. The timer 62 is operationally coupled to the microprocessor 60. The timer 62 is positioned to signal the microprocessor 60 upon elapsing of a respective period of time. The microprocessor 60 is positioned to implement a sequence of simultaneous sounding the horn 54 and strobing the bulbs 56 for preset periods of time, and at respective intervals of time, and then to deactivate the sensor 52, the horn 54, and the bulbs 56. For example, the microprocessor 60 may actuate the horn 54 and the bulbs 56 after a one second interval measured from detection of the intruder by the sensor 52. The horn 54 and bulbs 56 may be preset for a first pulse, lasting two seconds, of sounding and strobing, respectively. This may be followed three seconds later by a second pulse, also lasting two seconds, of sounding and strobing. After the second pulse, the microprocessor 60 would deactivate the sensor 52, the horn 54, and the bulbs 56.

A button 64, which is depressible, is coupled to the top 38 of the housing 12. The button 64 is operationally coupled to the microprocessor 60. The button 64 is configured to be selectively depressed to signal the microprocessor 60 to activate the sensor 52, the horn 54, and the bulbs 56, effectively resetting the device 10.

In use, the device 10 is positioned proximate to an entry point of a structure. The button 64 is depressed to activate the device. Should an intruder enter the area proximate to the front 16 of the housing 12, the microprocessor 60 would sound the horn 54 and strobe the bulbs 56 to disorient the intruder and to alert the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An intruder alarm and disorienting device comprising:

a housing defining an interior space;

a battery coupled to the housing and positioned in the interior space;

a sensor coupled to a front of the housing;

a horn coupled to the front of the housing;

a plurality of bulbs coupled to the front of the housing;

a microprocessor coupled to the housing and positioned in the interior space, the microprocessor being operationally coupled to the battery, the sensor, the bulbs, and the horn wherein the sensor is configured for detecting an intruder entering an area proximate to the front of the housing and for signaling the microprocessor positioning the microprocessor for sounding the horn and strobing the bulbs for disorienting the intruder and for alerting a user;

a handle coupled to a top of the housing wherein the handle is configured for grasping in a hand of the user for lifting the housing; and a plurality of couplers, each coupler being coupled to a respective opposing side of the housing wherein the couplers are configured for selectively coupling to a substantially vertical surface for coupling the housing to the substantially vertical surface with the housing extending substantially perpendicularly from the substantially vertical surface, the plurality of couplers comprising four couplers positioned two-apiece on each opposing side of the housing, each coupler comprising a hole and a channel, the channel extending from the hole toward the front of the housing wherein the hole is configured for inserting a head of an article of mounting hardware such that the channel is positioned for inserting a shaft of the article of mounting hardware for coupling the housing to the substantially vertical surface.

2. The device of claim 1, further including the housing being substantially rectangularly box shaped.

3. The device of claim 2, further including the front being flattened hexagonally shaped, the housing having a back, the back being convexly arcuate.

4. The device of claim 3, further including a plurality of feet coupled to a bottom of the housing wherein the feet are configured for stabilizing the housing on a substantially horizontal surface.

5. The device of claim 4, further including the plurality of feet comprising a pair of bars, the pair of bars bracketing a midline of the bottom.

6. The device of claim 1, further including the handle comprising a pair of first rods and a second rod, each first rod being coupled to and extending from the top of the housing, the second rod being coupled to and extending between the first rods distal from the housing defining a slot wherein the slot is configured for inserting digits of the hand of the user for grasping the second rod for lifting the housing.

7. The device of claim 1, further comprising:

the battery being rechargeable; and a connector coupled to the housing, the connector being operationally coupled to the battery wherein the connector is configured for inserting a plug for coupling the battery to a source of direct current for recharging the battery.

8. The device of claim 7, further including the connector comprising a Universal Serial Bus port.

9. The device of claim 7, further including the connector being positioned on a bottom of the housing.

10. The device of claim 1, further including the sensor being passive infrared type.

11. The device of claim 1, further including the horn being centrally positioned on the front of the housing.

12. The device of claim 1, further including the plurality of bulbs comprising three bulbs, two of the bulbs being positioned singly proximate to opposing sides of the housing, one of the bulbs being positioned proximate to a top of the housing equally distant from opposing sides of the housing.

13. The device of claim 1, further including each bulb comprising a set of light emitting diodes.

14. The device of claim 13, further including each set of light emitting diodes comprising three light emitting diodes.

15. The device of claim 1, further comprising:

a timer coupled to the housing and positioned in the interior space, the timer being operationally coupled to the microprocessor wherein the timer is positioned for signaling the microprocessor upon elapsing of a respective period of time wherein the microprocessor is positioned for implementing a sequence of sounding the horn and strobing the bulbs for preset periods of time and at respective intervals of time and then for deactivating the sensor, the horn, and the bulbs; and a button coupled to a top of the housing, the button being depressible, the button being operationally coupled to the microprocessor wherein the button is configured for selectively depressing for signaling the microprocessor for activating the sensor, the horn, and the bulbs.

16. An intruder alarm and disorienting device comprising:

a housing defining an interior space, the housing being substantially rectangularly box shaped, the housing having a front and a back, the front being flattened hexagonally shaped, the back being convexly arcuate;

a plurality of feet coupled to a bottom of the housing wherein the feet are configured for stabilizing the housing on a substantially horizontal surface, the plurality of feet comprising a pair of bars, the pair of bars bracketing a midline of the bottom;

a plurality of couplers, each coupler being coupled to a respective opposing side of the housing wherein the couplers are configured for selectively coupling to a substantially vertical surface for coupling the housing to the substantially vertical surface with the housing extending substantially perpendicularly from the substantially vertical surface, the plurality of couplers comprising four couplers positioned two-apiece on each opposing side of the housing, each coupler comprising a hole and a channel, the channel extending from the hole toward the front of the housing wherein the hole is configured for inserting a head of an article of mounting hardware such that the channel is positioned for inserting a shaft of the article of mounting hardware for coupling the housing to the substantially vertical surface;

a handle coupled to a top of the housing wherein the handle is configured for grasping in a hand of a user for lifting the housing, the handle comprising a pair of first rods and a second rod, each first rod being coupled to and extending from the top of the housing, the second rod being coupled to and extending between the first rods distal from the housing defining a slot wherein the slot is configured for inserting digits of the hand of the user for grasping the second rod for lifting the housing;

a battery coupled to the housing and positioned in the interior space, the battery being rechargeable;

a connector coupled to the housing, the connector being operationally coupled to the battery wherein the connector is configured for inserting a plug for coupling the battery to a source of direct current for recharging the battery, the connector comprising a Universal Serial Bus port, the connector being positioned on the bottom of the housing;

a sensor coupled to the front of the housing, the sensor being passive infrared type;

a horn coupled to the front of the housing, the horn being centrally positioned on the front of the housing;

a plurality of bulbs coupled to the front of the housing, the plurality of bulbs comprising three bulbs, two of the bulbs being positioned singly proximate to the opposing sides of the housing, one of the bulbs being positioned proximate to the top of the housing equally distant from the opposing sides of the housing, each bulb comprising a set of light emitting diodes, each set of light emitting diodes comprising three light emitting diodes;

a microprocessor coupled to the housing and positioned in the interior space, the microprocessor being operationally coupled to the battery, the sensor, the bulbs, and the horn wherein the sensor is configured for detecting an intruder entering an area proximate to the front of the housing and for signaling the microprocessor positioning the microprocessor for sounding the horn and strobing the bulbs for disorienting the intruder and for alerting the user;

a timer coupled to the housing and positioned in the interior space, the timer being operationally coupled to the microprocessor wherein the timer is positioned for signaling the microprocessor upon elapsing of a respective period of time wherein the microprocessor is positioned for implementing a sequence of sounding the horn and strobing the bulbs for preset periods of time and at respective intervals of time and then for deactivating the sensor, the horn, and the bulbs; and a button coupled to the top of the housing, the button being depressible, the button being operationally coupled to the microprocessor wherein the button is configured for selectively depressing for signaling the microprocessor for activating the sensor, the horn, and the bulbs.

* * * * *